US007299953B2

(12) United States Patent
McLisky

(10) Patent No.: US 7,299,953 B2
(45) Date of Patent: Nov. 27, 2007

(54) DISPENSER

(76) Inventor: Nigel Haig McLisky, 31A Hannigan Drive, Panmure, Auckland (NZ) 1003

( * ) Notice: Subject to any disclaimer, the term of this patent is extended or adjusted under 35 U.S.C. 154(b) by 0 days.

(21) Appl. No.: 10/514,246

(22) PCT Filed: May 23, 2003

(86) PCT No.: PCT/NZ03/00103

§ 371 (c)(1),
(2), (4) Date: Nov. 17, 2005

(87) PCT Pub. No.: WO03/099682

PCT Pub. Date: Dec. 4, 2003

(65) Prior Publication Data

US 2006/0151546 A1 Jul. 13, 2006

(30) Foreign Application Priority Data

May 24, 2002 (NZ) ..... 519138

(51) Int. Cl.
*B65D 83/00* (2006.01)

(52) U.S. Cl. ..... 222/402.13; 222/645

(58) Field of Classification Search ..... 222/645, 222/402.13

See application file for complete search history.

(56) References Cited

U.S. PATENT DOCUMENTS

| | | | | |
|---|---|---|---|---|
| 3,419,189 | A * | 12/1968 | Iketani | 222/54 |
| 3,596,800 | A * | 8/1971 | Iketani | 222/54 |
| 3,685,693 | A * | 8/1972 | Iketani | 222/54 |
| 6,216,925 | B1 * | 4/2001 | Garon | 222/645 |

* cited by examiner

*Primary Examiner*—Philippe Derakshani
(74) *Attorney, Agent, or Firm*—Bio Intellectual Property Services (Bio IPS) LLC; O. M. (Sam) Zaghmout

(57) ABSTRACT

A dispenser, the dispenser having a dispenser head 2 and a container 1 containing spray material; the container having a containment portion and an attachment portion 5, the attachment portion having a threaded part 6 and a non-threaded part 7, the threaded part 6 having a greater diameter than the non-threaded part 7, and the threaded part 6 being between the non-threaded part 7 and the containment portion; the spray head being formed complimentary to the attachment portion such that a threaded part of the spray head engages the threaded part of the attachment portion and wherein the non-threaded part of the attachment portion is further inwards of the dispenser head than the threaded part of the attachment portion; the dispenser being formed such that when the container is fitted to the dispenser head the spray material can move through the attachment portion into the dispenser head, and can leave the dispenser to enter an atmosphere as a spray.

9 Claims, 2 Drawing Sheets

DISPENSER

CROSS-REFERENCE TO RELATED APPLICATIONS

This application claims priority from PCT/NZ03/00103, entitled A DISPENSER, filed May 23, 2003. The entire content of it is incorporated herein by a reference.

FEDERALLY SPONSORED RESEARCH

Not Applicable.

SEQUENCE LISTING OR PROGRAM

Not Applicable.

BACKGROUND OF THE INVENTION

1. Field of Invention

This invention relates to a dispenser.

2. Background

It is known to use dispensers to automatically release a spray material into an atmosphere at timed intervals. These comprise a dispenser head fitted to a spray material container. Spray material moves from within the container to the spray head, and is then released into the atmosphere as a spray. The spray material may be an odour neutraliser, a disinfectant, an insecticide, or any other suitable substance. When the spray material is exhausted the container can be removed from the spray head and re-filled or replaced altogether. A problem with many known dispensers is that the connection between the spray head and the container is undesirably susceptible to damage. It is accordingly an object of at least one form of the present invention to go at least some way towards addressing this problem, or to at least provide the public with a useful choice.

The term "comprise", "comprises", "comprised", or "comprising", if and when used in this document should be interpreted non-exclusively, i.e. should be interpreted non-exclusively to mean "consisting or including".

GENERAL DESCRIPTION

According to one aspect of the invention there is provided a dispenser, the dispenser having a dispenser head and a container containing spray material;

the container having a containment portion and an attachment portion, the attachment portion having a threaded part and a non-threaded part, the threaded part having a greater diameter than the non-threaded part, and the threaded part being between the non-threaded part and the containment portion;

the spray head being formed complimentary to the attachment portion such that a threaded part of the dispenser head engages the threaded part of the attachment portion and wherein the non-threaded part of the attachment portion is further inwards of the dispenser head than the threaded part of the attachment portion;

the dispenser being formed such that when the container is fitted to the dispenser head the spray material can move through the attachment portion into the dispenser head, and can leave the dispenser to enter an atmosphere as a spray.

Preferably the non-threaded and threaded parts of the attachment portion are of approximately the same length.

Preferably the attachment portion is substantially in the form of a pedestal extending from the containment portion.

Preferably the non-threaded part of the attachment portion terminates with a projection, optionally in the form of a small plateau.

Preferably the attachment portion is part of a valve.

Preferably the container has a wall, optionally in the form of a ring, surrounding the attachment portion to substantially protect the attachment portion.

Preferably the dispenser can emit the spray automatically at preset timed intervals.

Preferably the dispenser head has an actuator extending into the container to facilitate flow of the spray material into the dispenser head.

Preferably the spray material is in a liquid form while within the container.

According to one aspect of the invention the dispenser head having an actuator tube, the tube having a downwardly cantilevered end part which is surrounded by the threaded part of the dispenser head, the tube penetrating the attachment portion to provide a conduit for the spray material to move from the containment portion to the dispenser head.

BRIEF DESCRIPTION OF DRAWINGS

Some preferred aspects of the invention will now be described by way of example, and with reference to the accompanying drawings, of which.

DETAILED DESCRIPTION

Figure 1:
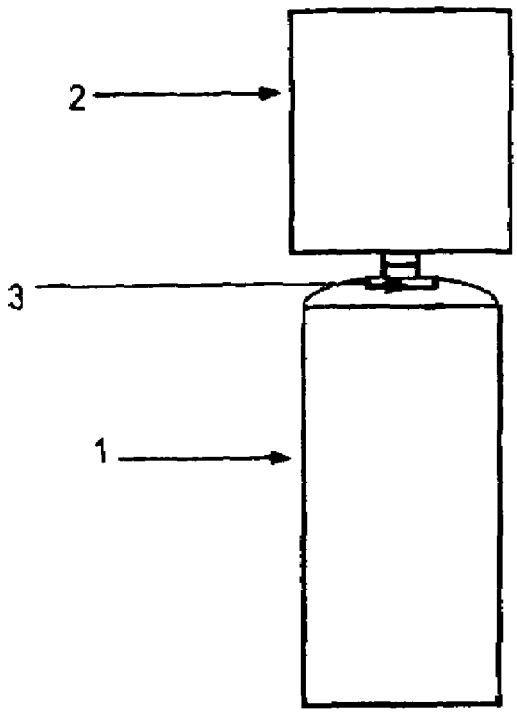
FIG. 1 shows a dispenser having a dispenser head and a container.
Figure 2:
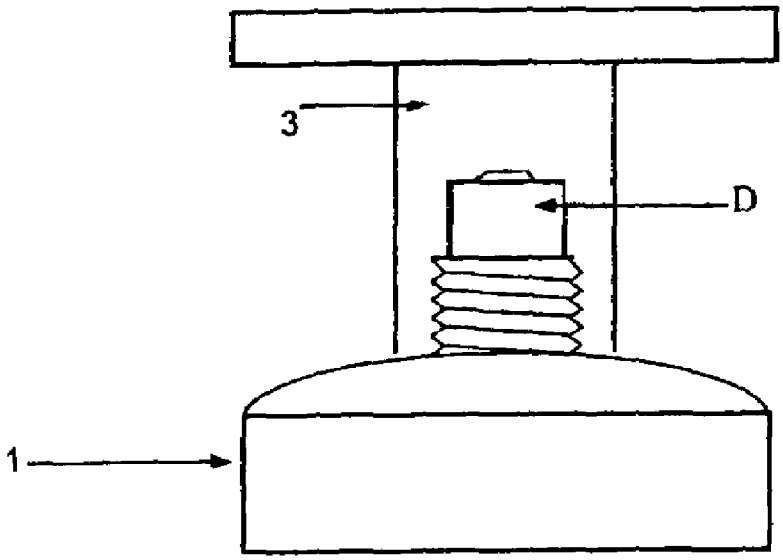
FIG. 2 shows a connection between the dispenser head and the container in cross section.

Referring to FIG. 1, there is shown a spray dispenser having a container 1, and a spray dispenser head 2. The container 1 and the dispenser head 2 are releasably engaged with one another as shown at 3. The relationship of this engagement is shown in expanded view at FIG. 2.

Figure 3:
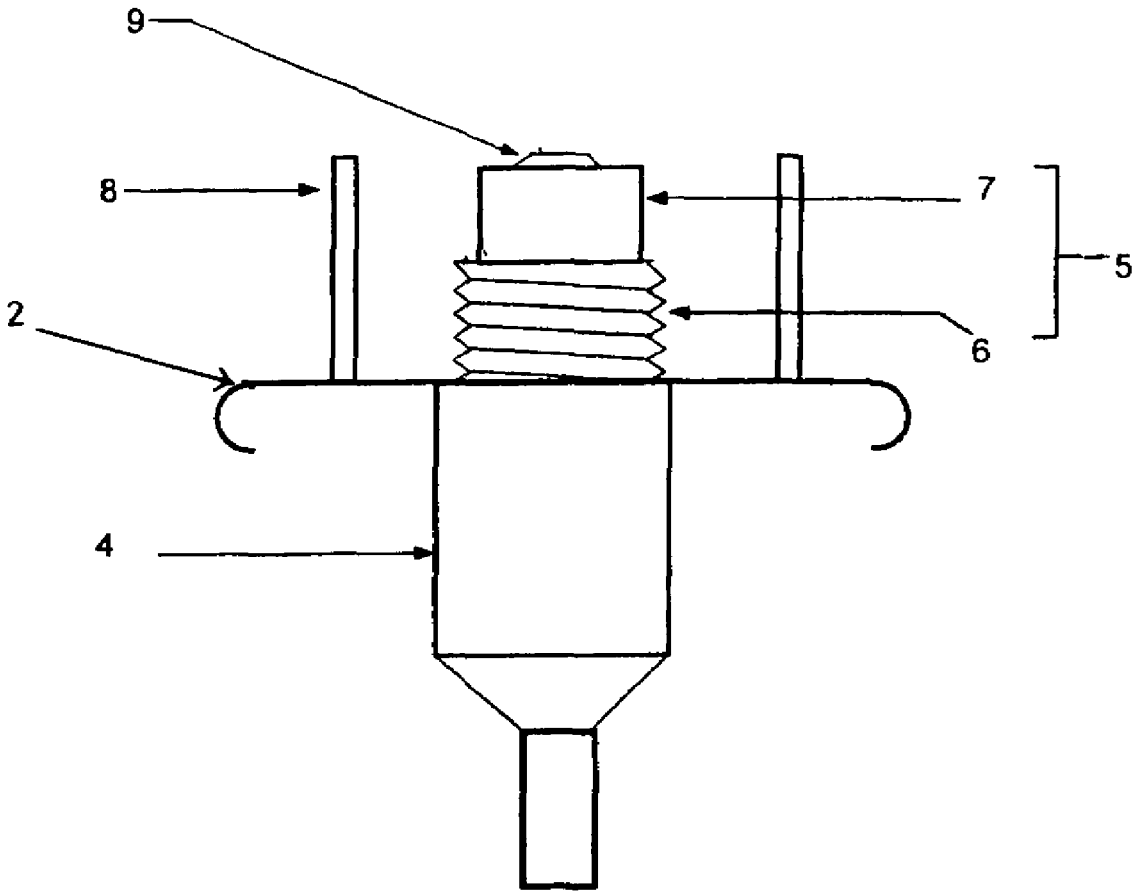
FIG. 3 shows detail of an attachment portion of part of the container.

Referring to FIG. 3, the container 1 incorporates a valve 4. The valve has an attachment portion in the form of a pedestal 5. The pedestal has a threaded part 6 and a distal non-threaded part 7, each being of approximately the same length. As shown, the threaded part 6 has a slightly larger diameter than the non-threaded part 7. A wall 8 extends around the pedestal in the form of a ring to provide it with a measure of protection. Further, the non-threaded part 7 of the pedestal terminates with a raised portion or projection 9, preferably in the form of a small plateau.

Figure 4:
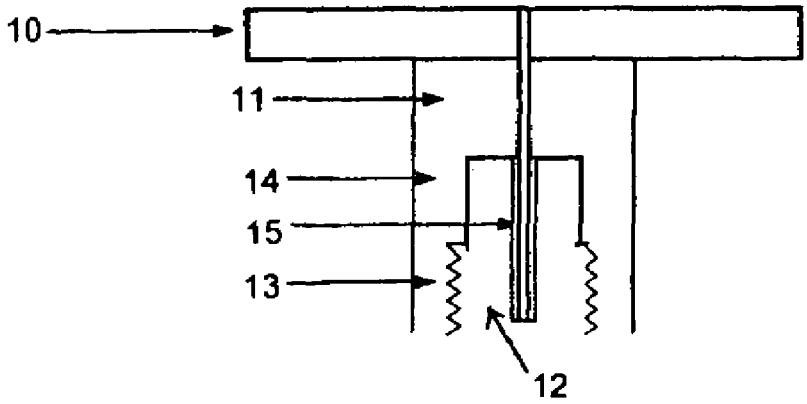
FIG. 4 shows detail of part of the container head complimentary to the attachment portion of FIG. 3.

The lower part 10 of the dispenser head 2 which engages with the pedestal is shown at FIG. 4. More specifically, the lower part 10 has a downwards stem 11 with a recess 12 for receiving the pedestal 5. In this regard the stem 11 has a threaded part 13 and a non-threaded part 14 complimentary to the threaded and non-threaded parts 6 and 7 of the pedestal 5 respectively. The threaded parts of the pedestal 5 and stem 11 thus engage one another, and the non-threaded part 7 of the pedestal fits into the non-threaded part 14 of the stem.

With further reference to FIG. 4, the dispenser head includes an actuator 15 which penetrates the pedestal 5 and provides a conduit for spray material to move from the container 1 and into the spray head 2.

An advantage of the invention, in at least a preferred embodiment, is that the pedestal 5 essentially guides the container 1 into the dispenser head 2 prior to these being screwed together. With many known arrangements it is not easy to locate the container with respect to the dispenser, which can result in damage to the screw thread. Further, the fact that the threaded part 6 of the pedestal 5 is located below the uppermost part of the wall 8 means that the thread is significantly protected.

Those skilled in the art will appreciate that the invention described herein may facilitate clean and easy removal of the container 1 from the dispenser head 2 when the spray material therein is exhausted. It will also be appreciated that the invention may be used in a way that makes it difficult to fit non-approved containers to the dispenser head 2. This is advantageous as the contents of non-approved containers may damage the dispenser head.

The invention may be formed to facilitate accurate fitting of the container 1 to the dispenser head 2. The combination of the different diameters of the threaded 6 and non-threaded 7 parts of the pedestal 5 assist in preventing one from screwing the container 2 further into the dispenser head 2 than is desirable. In this way undesired forms of contact between the pedestal 5 and the dispenser head 2 can be avoided. The arrangement may also facilitate optimal positioning of the actuator 15 within the valve 4. A problem with some prior art dispensers is that they may allow an actuator to penetrate too deep into the valve or container, resulting in a tendency for the container's contents to leak. Conversely, if the depth of penetration is insufficient, as is a possibility with some prior art dispensers, the container valve will not open to allow access to the container's contents.

Some embodiments of the invention eliminate damage to the top of the valve 4 caused by over-tightening of the container with respect to the dispenser head. This is advantageous as over-tightening could lead to the valve 4 being crushed and damaged.

Preferably the dispenser of the invention is formed such that the container 1 can be re-filled when its contents are exhausted, ie through the valve 4.

The dispenser is preferably of an automatic type, having electronic components, etc, to enable it to be left in place to release a spray of spray material into an atmosphere at timed intervals. Preferably the invention is used to deliver aerosol type sprays, but it may also be used in the context of non-aerosol sprays.

While some preferred forms of the inventions have been described by way of example, it should be appreciated that improvements and modifications can occur without departing from the scope of the following claims.

The invention claimed is:

1. A dispenser, the dispenser having a dispenser head and a container containing spray material;

the container having a containment portion and an attachment portion, the attachment portion having a threaded part and a non-threaded part, the threaded part having a greater diameter than the non-threaded part, and the threaded part being between the non-threaded part and the containment portion;

the dispenser head formed complimentary to the attachment portion such that a threaded part of the dispenser head engages the threaded part of the attachment portion and wherein the non-threaded part of the attachment portion is further inwards of the dispenser head than the threaded part of the attachment portion;

the dispenser head having an actuator tube, the tube having a downwardly cantilevered end part which is surrounded by the threaded part of the dispenser head, the tube penetrating the attachment portion to provide a conduit for the spray material to move from the containment portion to the dispenser head;

the dispenser being formed such that when it is in use with the container fitted to the dispenser head the dispenser can effect automatic preset timed release of the spray material wherein the spray material moves through the attachment portion into the dispenser head, and leaves the dispenser to enter an atmosphere as a spray.

2. A dispenser according to claim 1, wherein the non-threaded and threaded parts of the attachment portion are of approximately the same length.

3. A dispenser according to claim 1, wherein the attachment portion is substantially in the form of a pedestal extending from the containment portion.

4. A dispenser according to claim 1, wherein the non-threaded part of the attachment portion terminates with a projection in the form of a plateau.

5. A dispenser according to claim 1, wherein the attachment portion is part of a valve.

6. A dispenser according to claim 1, wherein the container has a wall surrounding the attachment portion to substantially protect the attachment portion.

7. A dispenser according claim 1, wherein the spray material is in a liquid form while within the container.

8. A dispenser according to any claim 1, wherein the spray material is an aerosol spray material.

9. A dispenser, the dispenser having a dispenser head and a container containing spray material;

the container having a containment portion and an attachment portion, a wall surrounding the attachment portion to substantially protect the attachment portion, the attachment portion being substantially in the form of a pedestal extending from the containment portion, the attachment portion having a threaded part and a non-threaded part, the threaded part terminating and the non-threaded part proceeding therefrom with a projection substantially in the form of a plateau, the threaded part having a greater diameter than the non-threaded part, and the threaded part being between the non-threaded part and the containment portion;

the dispenser head formed complimentary to the attachment portion such that a threaded part of the dispenser head engages the threaded part of the attachment portion and wherein the non-threaded part of the attachment portion is further inwards of the dispenser head than the threaded part of the attachment portion;

the dispenser head having an actuator tube, the tube having a downwardly cantilevered end part which is surrounded by the threaded part of the dispenser head, the tube penetrating the attachment portion to provide a conduit for the spray material to move from the containment portion to the dispenser head;

the dispenser being formed such that when it is in use with the container fitted to the dispenser head the dispenser can effect automatic preset timed release of the spray material wherein the spray material moves through the attachment portion into the dispenser head, and leaves the dispenser to enter an atmosphere as a spray.

* * * * *